US007936362B2

(12) United States Patent
Gelhaus et al.

(10) Patent No.: US 7,936,362 B2
(45) Date of Patent: May 3, 2011

(54) SYSTEM AND METHOD FOR SPREADING A NON-PERIODIC SIGNAL FOR A SPATIAL LIGHT MODULATOR

(75) Inventors: Matthew Gelhaus, Albany, OR (US); Winthrop D. Childers, San Diego, CA (US); Art Piehl, Corvallis, OR (US); Jim Przybyla, Philomath, OR (US); Adam Ghozeil, Corvallis, OR (US); Eric T. Martin, Corvallis, OR (US)

(73) Assignee: Hewlett-Packard Development Company L.P., Houston, TX (US)

( * ) Notice: Subject to any disclaimer, the term of this patent is extended or adjusted under 35 U.S.C. 154(b) by 2016 days.

(21) Appl. No.: 10/909,087

(22) Filed: Jul. 30, 2004

(65) Prior Publication Data

US 2006/0023000 A1 Feb. 2, 2006

(51) Int. Cl.
*G09G 5/10* (2006.01)

(52) U.S. Cl. ..... 345/690

(58) Field of Classification Search ..... 345/94, 345/96, 100, 84, 88, 690, 691, 694; 348/84, 348/743

See application file for complete search history.

(56) References Cited

U.S. PATENT DOCUMENTS 5,168,406 A 12/1992 Nelson
5,452,138 A 9/1995 Mignardi et al.
5,497,172 A * 3/1996 Doherty et al. ..... 345/85
5,619,228 A 4/1997 Doherty
5,828,349 A 10/1998 MacHesney et al.
5,835,255 A 11/1998 Miles
5,852,630 A * 12/1998 Langberg et al. ..... 375/219
5,982,384 A 11/1999 Prouty et al.
5,986,721 A * 11/1999 Jones et al. ..... 348/743
6,034,660 A 3/2000 Millward et al.
6,061,049 A 5/2000 Pettitt et al.
6,151,001 A 11/2000 Anderson et al.
6,175,355 B1 1/2001 Reddy
6,204,855 B1 3/2001 Khaund
6,377,270 B1 4/2002 Eitzmann
6,388,647 B2 5/2002 Leung et al.
6,437,781 B1 8/2002 Tucker et al.
6,473,092 B1 10/2002 Sojourner
6,567,134 B1 5/2003 Morgan
6,583,940 B2 6/2003 Nishikawa et al.
6,585,378 B2 7/2003 Kurtz et al.
6,590,549 B1 7/2003 Marshall
7,092,137 B2 * 8/2006 Childers ..... 359/237
2002/0122044 A1 9/2002 Deering
2003/0001953 A1 * 1/2003 Rancuret et al. ..... 348/84
2003/0034981 A1 2/2003 Wada
2003/0072070 A1 4/2003 Miles
2004/0041825 A1 * 3/2004 Willis ..... 345/694
2005/0146542 A1 * 7/2005 Hewlett et al. ..... 345/698

* cited by examiner

*Primary Examiner* — Quan-Zhen Wang
*Assistant Examiner* — Shaheda A Abdin

(57) ABSTRACT

A method is disclosed for spreading a non-periodic color signal sent to a spatial light modulator across a frame period. The method can include the operation of dividing a frame period into a plurality of time slices. A further operation can be assigning a color to each of the plurality time slices. Another operation can be interleaving one or more colors assigned to the time slices across the frame period in a non-periodic manner.

36 Claims, 6 Drawing Sheets

SYSTEM AND METHOD FOR SPREADING A NON-PERIODIC SIGNAL FOR A SPATIAL LIGHT MODULATOR

FIELD OF THE INVENTION

The present invention relates generally to the use of spatial light modulators.

BACKGROUND

Spatial light modulators (SLM) have been around for over 25 years. Recent advancements have allowed the SLM to be used in a wide variety of fields, such as microscopy, holographic imaging, data storage, DNA synthesis, offset printing, and image projection, to name a few. Using technology developed for the microchip fabrication industry, the SLM has become one of the most successful micro-electro mechanical systems. One form of SLM, a Digital Micromirror Device (DMD) has over 1 million mirrors arrayed on a small chip.

A DMD can have a two dimensional array of microscopic mirrors. In a typical DMD, each mirror may have an area of 16 square micrometers. The mirrors are spaced only 1 micrometer apart. Each mirror can be attached to a micro-electronic (MEMS) device and a hinge, allowing a computer to control the direction that each mirror is pointing. Due in part to the mirror's extremely small size, the direction it is facing can be changed thousands of times per second. The mirror is considered to be in an "on" position when the mirror reflects light onto a display screen. The mirror is off when the light is not reflected. By controlling the percentage of time that the mirror is on or off, at least 1024 shades of gray can be shown on the screen for each mirror. With an array of 1000×1000 mirrors, the DMD can project a video image with a million pixels. Digital projectors using DMD technology are now used to show movies with unprecedented clarity. DMD chips are also used in high definition large screen televisions and lightweight digital video projectors used in offices and home theaters. However, the chip's binary design, allowing each mirror to be either on or off, creates a limitation in its ability to reproduce color images.

Presently, two methods are used in most systems for colorizing a DMD projected image. The first method involves splitting white light using a prism into its red, blue, and green components. Each color is then input into its own DMD chip, with the three outputs directed so that their combined image appears to be full color to the human eye. This method works well for high quality expensive display devices such as Movie Theater projectors. However, the expense of using three chips, combined with the necessary opto-mechanical structure to focus and align the three outputs, creates a system that is prohibitively expensive to be used in consumer applications.

A second method for colorizing a DMD projected image attempts to overcome the expense of using three chips. In the second method, a single DMD chip is used with a transparent rotating color wheel between the light source and the DMD chip. The color wheel's rotation is synchronized with the movement of the micromirrors, allowing a micromirror to turn on when the correct color is shining through the color wheel. Using a red, green, and blue color wheel, each color is able to shine on the mirror ⅓ of the time. By rotating the color wheel fast enough, a red, green, or blue pixel can be displayed on the projection screen when needed, allowing a full color image to be produced.

There are at least two limitations that narrow the DMD's use in consumer applications, however. First, the use of a sequential color wheel limits the overall brightness of each color to less than ⅓ of the intensity of the light source. The brightness is decreased because each color can only shine through ⅓ of the time in a color wheel with 3 colors. Second, due to the sequential nature of the color wheel system, visual artifacts appear on the display screen caused by the strict periodic ordering of the sequential system. These limitations narrow the usefulness of a DMD chip in a high definition projection system, since brightness and clarity are two of the most important aspects of such a system.

SUMMARY OF THE INVENTION

A method is disclosed for spreading a non-periodic color signal sent to a spatial light modulator across a frame period. The method can include the operation of dividing a frame period into a plurality of time slices. A further operation can be assigning a color to each of the plurality time slices. Another operation can be interleaving one or more colors assigned to the time slices across the frame period in a non-periodic manner.

DETAILED DESCRIPTION

Figure 1A:
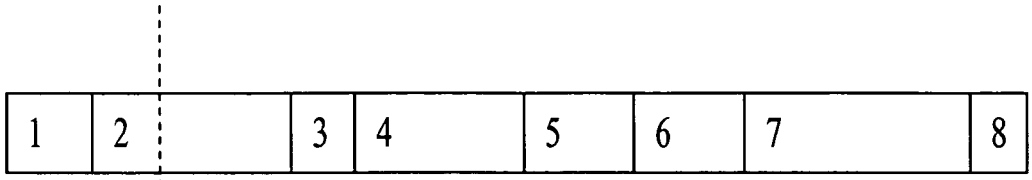
FIGS. 1*a-d* depict a frame period divided up into a sequence of time slices in an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Embodiments of the present invention include a method and system for generating color pixels on a viewing surface using a light modulator (i.e., a color modulator or spatial light modulator). A light modulator for the present invention includes an array of color pixel elements that each modulate color independently of one another. The terms "modulate color" or "outputs a primary color" refer to changing the spectral distribution of the incoming light. For example, one pixel element of the light modulator may receive incoming essentially white light and output a color distribution that has a peak at a particular wavelength such as red, green, blue, yellow, cyan, magenta, orange, violet, or some other color. In addition, the light modulator may have a "black state". Alternatively, the light modulator may be used with a second light modulator for helping to achieve a darker black state or to enable an expanded color gamut.

The light modulator is utilized to generate an image on a viewing surface for a series of frames based on an incoming video signal. Each image is generated by projecting an array of pixels on the viewing surface. During a particular frame, each pixel element has a color value defining hue and intensity of the pixel and the color value is derived from the incoming video signal. A particular pixel element of the light modulator is utilized to generate the color value for the pixel on the viewing surface.

In this specification, a "frame period" is generally defined as a time period during which a display system generates a representation of a digital frame onto a viewing surface. A "digital frame" may generally be defined by a data array representing the image for one frame period. In an exemplary embodiment, the frame period may have, but is not limited to, a duration of $1/30^{th}$ to $1/75^{th}$ of a second.

To generate the color value, the pixel element can output one or more primary colors. In the context of the present invention, primary colors are any discrete colors chosen to be output by a pixel element of the light modulator. More specifically, a "primary color" in the context of this invention can be one of a discrete set of primary colors, such as black, red, green, and blue, or it can be any color selected from a continuous range of the visible colors from and including violet to red. Thus, a "primary color" in this context can be black, red, green, blue, yellow, orange, violet, cyan, magenta, black, or any other color in the visible spectra.

To provide the desired color output, a frame period is divided up into a time slice sequence including a sequence of time slices as depicted in FIG. 1*a*. FIG. 1*a* depicts a frame period divided up into a sequence of time slices labeled 1-8. A time slice is a time period during which the pixel element outputs a particular primary color. The time slices may be of equal duration or they can be of varying time duration (i.e., width) to increase the number of apparent intensity levels that can be displayed for a given number of time slices. In one embodiment, the time slices can have durations corresponding to binary weightings (meaning that the time duration of each slice roughly corresponds to a binary number). For example, the number of time slices that can be used to provide 8-bit color or 256 color levels is 8 time slices. Alternatively, the time slices can have varying durations that do not directly correlate with binary weightings.

Figure 1B:
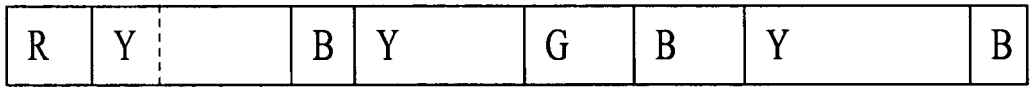
Figure 1C:
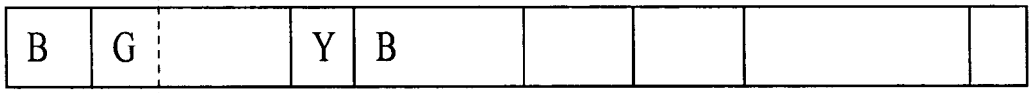
Figure 1D:
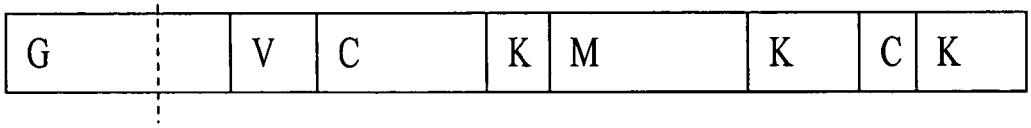

In order to generate the color values to be output, primary color values can be assigned to each of the time slices during each frame period. For a given pixel location or pixel element but for different frame periods, the same time slice may have a different primary color. An exemplary embodiment of some frame periods or a given pixel element in a frame is illustrated in FIGS. 1*b* to 1*d*. Exemplary primary colors are illustrated as R for red, Y for yellow, B for blue, G for green, K for black, etc.

In an embodiment of the present invention, the use of colors with the time slices is non-periodic. Any primary color can be assigned to any time slice regardless of its positioning relative to other time slices in the same frame or in other frames. Thus, for a given pixel and time slice, any of the primary colors can be assigned. For example, all of the time slices can be set to any non-black primary color when maximum saturation and brightness of that non-black primary color is desired. In contrast, a periodic system utilizes a color wheel and generates color time slices in the same sequence starting at the beginning of each frame period.

Alternatively, each primary color that is used to generate a pixel color during a frame period can be spread out across the entire frame period. To avoid visual artifacts, it is preferred to avoid placing all of a particular primary color contribution in one contiguous time portion of the frame period.

In one embodiment of the invention, a continuous range of primary colors is available, so that any hue can be provided by a single primary color. In this embodiment, the population and average duration of the time slices determines the intensity of that primary color. The continuous range of primary colors can generated using an analog color signal generation system or any other color generation system that can produce a continuous range of colors. Additionally, the intensity of the incoming color value may be controlled using pulse width modulation.

Selecting each of two complementary colors during a frame period can provide the white component of the pixel color. Stated another way, the white component during a frame period can be generated by selecting a color value for some of the time slices and the complement of the color value for other time slices. Exemplary pairs of complementary colors include yellow/blue, green/magenta, and red/cyan.

Yet another variation of the invention enables the white component of the color to be defined by a pair of complementary colors with the hue being defined by a single color selected from a continuous range of colors. For example, assigning yellow and blue to some of the time slices with an extra weighting on the yellow (e.g., more yellow time slices) can generate a pastel yellow pixel. Yellow and blue time slices of equal weight can combine to provide white light, but the additional yellow time slices provide the yellow hue shift.

As discussed previously, a color modulator is any apparatus or system configured to modulate the wavelength of light and reflect modulated light toward a display surface. In one embodiment, a color modulator is an interference based or interferometric modulator that modulates the spectral distribution of impinging light to generate an output color in response to an applied voltage signal. In this way, an interferometric modulator selects a color or spectral distribution that is transmitted to the display surface. In the case of an interferometric modulator, a color modulator is also known as a Fabry-Perot based light processing device.

In one embodiment, the color modulator array is a device including an array of cells or color pixel elements. Each color pixel element has the capability of receiving white light and outputting light having a color spectral distribution that is peaked about a particular wavelength, such as red, green, blue, cyan, yellow, magenta, violet, or other colors depending upon the design of color modulator.

Each physical cell can include an optical cavity whose dimension normal to the array of cells is responsive to the application of a voltage (or charge) across opposing plates that help to define the optical cavity. This can be done by controlling the voltage across the opposing plates or controlling charge injection to one or both of the opposing plates.

When white light impinges on each of the cells, each cell can reflect light having an intensity versus wavelength distribution that is peaked about a particular wavelength as a result of optical interference. Thus, the output of each cell is a voltage or charge selected peak wavelength. The light is then reflected from the cell to the viewing optics and/or display surface. Each cell may also have a black position (as a result of a particular input voltage or charge) wherein essentially no light is reflected from the cell. This can be referred to as the black condition for the light modulator cell.

Figure 2A:
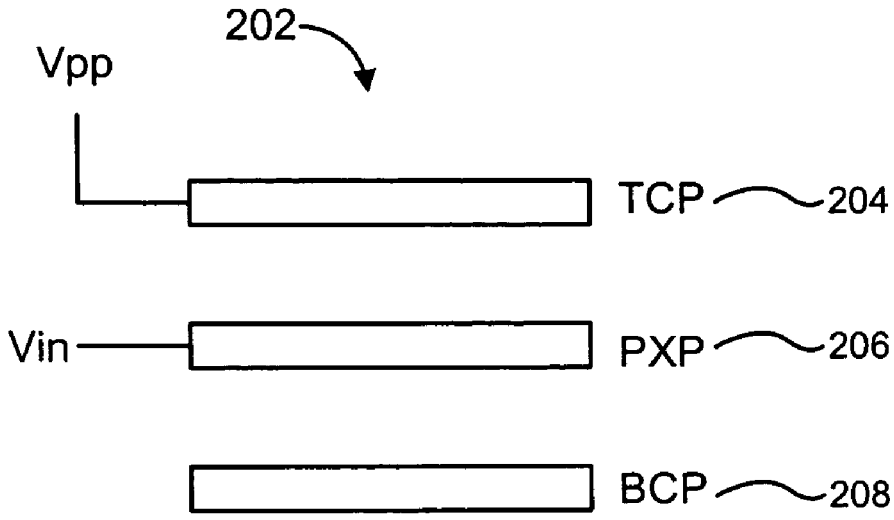
FIGS. 2*a* and 2*b* are diagrams depicting an apparatus for providing colored light in a digital light device in accordance with an embodiment of the present invention.

An example of a color modulator cell that can be used with the present invention will be described as shown in FIG. 2*a*.

The variable capacitor device 202 can comprise three plates, a top capacitor plate 204, a bottom capacitor plate 208, and a pixel plate 206. The top capacitor plate can have a voltage applied while the bottom capacitor plate can be set to ground. The pixel plate can have a variable voltage that causes the pixel plate to vary somewhere between the top and bottom capacitor plates, depending on the voltage or charge applied to the pixel plate.

The pixel plate 206 can take the place of the micro-mirror in a typical SLM. Rather than merely reflecting light off the micro-mirror, a variable capacitor 202 can reflect light off the pixel plate. The size of the gap created by applying a voltage to the pixel plate can determine the color of light reflected off the pixel plate. Ideally, as the pixel plate is moved from a location near the top capacitor plate to the bottom capacitor plate, a variable capacitor may produce a continuous range of colors across the visible spectrum.

Figure 2B:
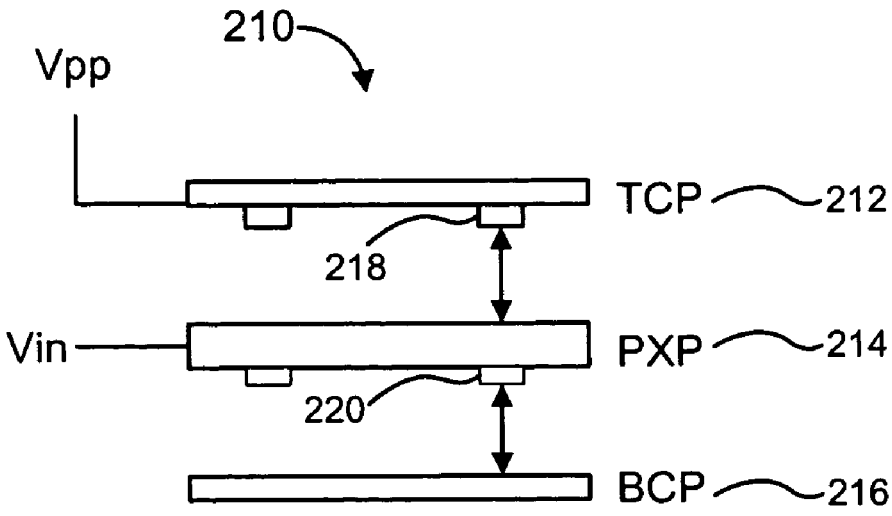

Another form of a variable capacitor is a dual capacitor device 210 as shown in FIG. 2*b*. This device has two sets of standoffs that allow the pixel plate 214 to be moved near the top capacitor plate 212 until the top standoffs 218 contact the top pixel plate. The top standoffs can be configured to allow a first gap, which would produce a corresponding color. The gap spacing can then be changed to modify the color. A different voltage can be applied to the pixel plate causing it to move near the bottom capacitor plate 216 until the bottom standoffs 220 contact the bottom capacitor plate. The thickness of the gap can determine another color of light that will be reflected off the pixel plate.

By eliminating the need for a color wheel, the visual artifacts present in color wheel systems can be reduced, projector brightness can be increased, and overall system cost can be decreased. In addition, the present invention provides a spatial light modulator that can be used in a low cost, high definition projection system.

Figure 3A:
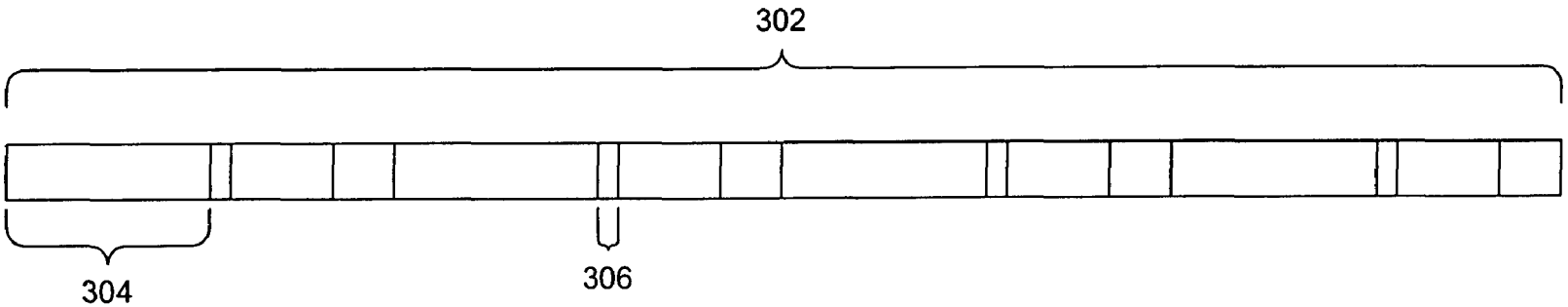
FIGS. 3*a-c* and 4*a-c* are timing diagrams showing spatial arrangements for spreading light in a non-periodic fashion in accordance with an embodiment of the present invention.

More specifically, a system and method can be provided for spreading a non-periodic color signal for a spatial light modulator across a frame period to avoid visual artifacts, as illustrated in FIGS. 3*a-c* and 4*a-c*. The amount of time a single frame is displayed is a frame period 302, as shown in FIG. 3*a*. A frame period can be divided into smaller time slices 304 and 306. By interleaving selected colors in the time slices throughout the frame period, millions of colors can be displayed on the screen.

Figure 3B:
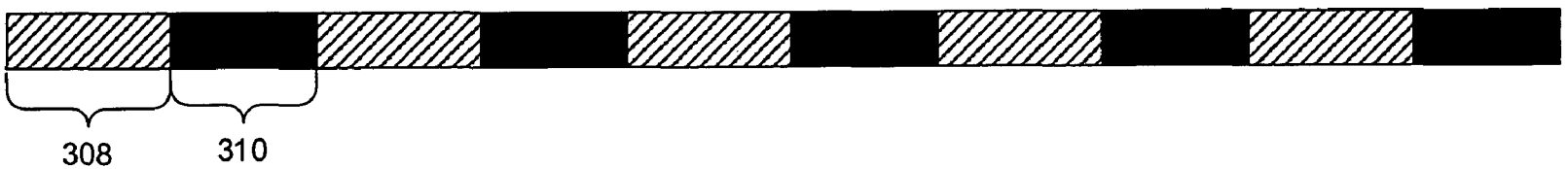

For example, it may be desirable for a pixel to appear red, but at half of the full intensity. The color red 308 can then be interleaved with black 310 throughout the frame period, as shown in FIG. 3*b*. Rather than populating the first half of the frame with red and the second half of the frame with black, an alternating sequence between red and black can be used to eliminate visual artifacts. Thus, at least two colors can be interleaved across the frame period to provide a proper intensity level.

Mixtures of primary colors, such as red, green, and blue (RGB) can be used to provide the desired color of the pixel. A white component can be created using a balanced component of the primary colors. For example, by combining equal amounts of red, green, and blue, the pixel will appear to be white. If the required color of the pixel was equal to 0.2R+0.2G+0.4B, the white component is 0.2W=0.2R+0.2G+0.2B. The amount remaining after the white component is subtracted in this case is the monochrome component of 0.2B. As discussed previously, the white component can also be represented using complimentary colors. The white component 0.2W can be represented by 0.2B+0.2Y since blue (cyan) and yellow are complementary. Thus, the desired color in the above example (0.2B) can be simplified to be the white component 0.2B+0.2Y plus the monochrome component in order to create 0.4B+0.2Y.

Figure 3C:
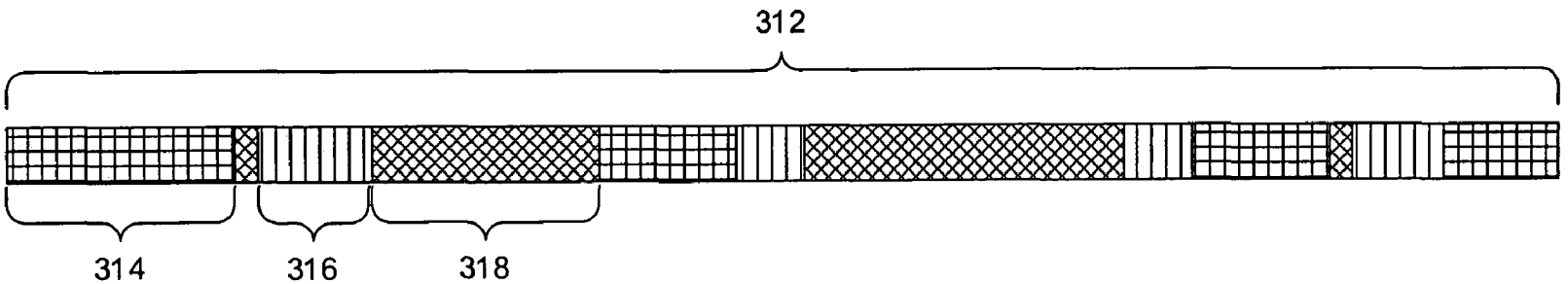

In another example of interleaving colors, blue and white can be used. To produce the desired color, the frame period can be set up to be 40% blue and 20% yellow, which will provide 20% blue and 20% white, as discussed above. As shown in FIG. 3*c*, the frame period 312 can be divided into three separate colors with 40% of the frame period displaying blue 314, 20% yellow 316, and the remaining 40% displaying black 318. By interleaving the colors, as shown in FIG. 3*c*, visual artifacts can be minimized.

Many configurations for dividing the frame periods into time slices can be used in the present invention. For example, the frame period may be divided up to allow for more than twenty-four bit color. This can be done in less than twenty-four time slices when a color modulator is used to produce just one or two of the primary colors to be interleaved. For example, twenty-four bit color can be provided for one primary color with eight time slices, as in FIG. 3*b*, and with 16 time slices when two primary color levels are used, as in FIG. 3*c*. The present invention has the ability to reduce the number of time slices used to represent a color and this has not been possible previously.

In one embodiment, the desired intensity of the light projected from each pixel can be represented by an intensity value, wherein the intensity value is equal to the number of time slices. The time slices can be spread evenly across the frame time by assigning time slices to each individual bit within the intensity value. More significant bits in the intensity value can have a proportionately greater number of time slices assigned to them with the bits spread out evenly over the frame time. In order to balance the number of time slices to the number of bits in the intensity value, the number of time slices can be $2^n-1$, where n is the number of bits in the intensity value.

Figure 4A:
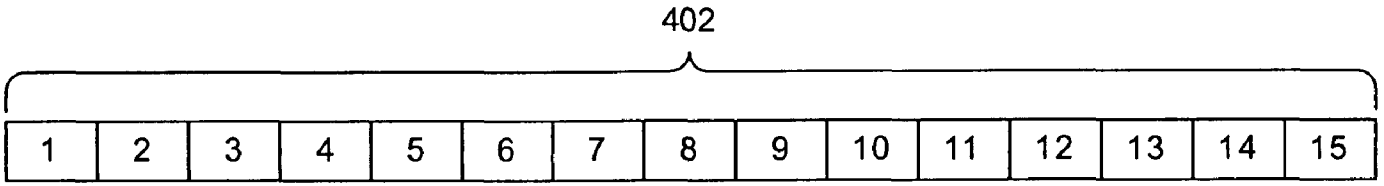
Figure 4B:
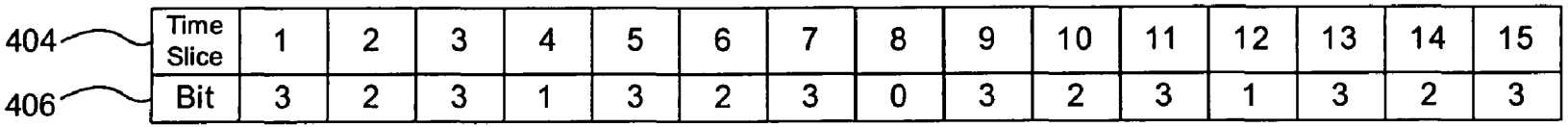
Figure 4C:
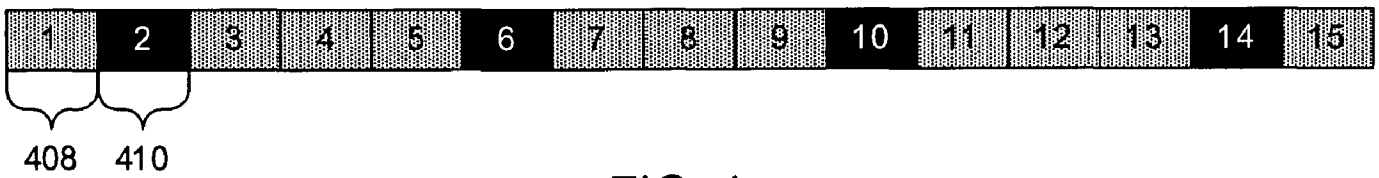

For example, consider the case of 15 time slices 402 and a 4-bit intensity value, as shown in FIG. 4*a*. Each time slice (1-15) 404 can be assigned to each bit (0-3) 406 of the intensity value as shown in FIG. 4*b*. Thus, the intensity value of 1011 binary (11 decimal) for the color blue 408 would be assigned to the time slices as shown in FIG. 4*c*, with eleven out of 15 time slices blue and the remaining four black. Alternatively, an 8-bit or N-bit scheme can be used.

The number of time slices possible may be limited by the switching time of the color modulator. However, a large number of time slices can generally be implemented. A single frame can be divided into 256 time slices, allowing digital light devices to be used to produce photorealistic images with millions of different color possibilities for each pixel. Even smaller divisions may be possible using the appropriate color modulators.

Figure 5:
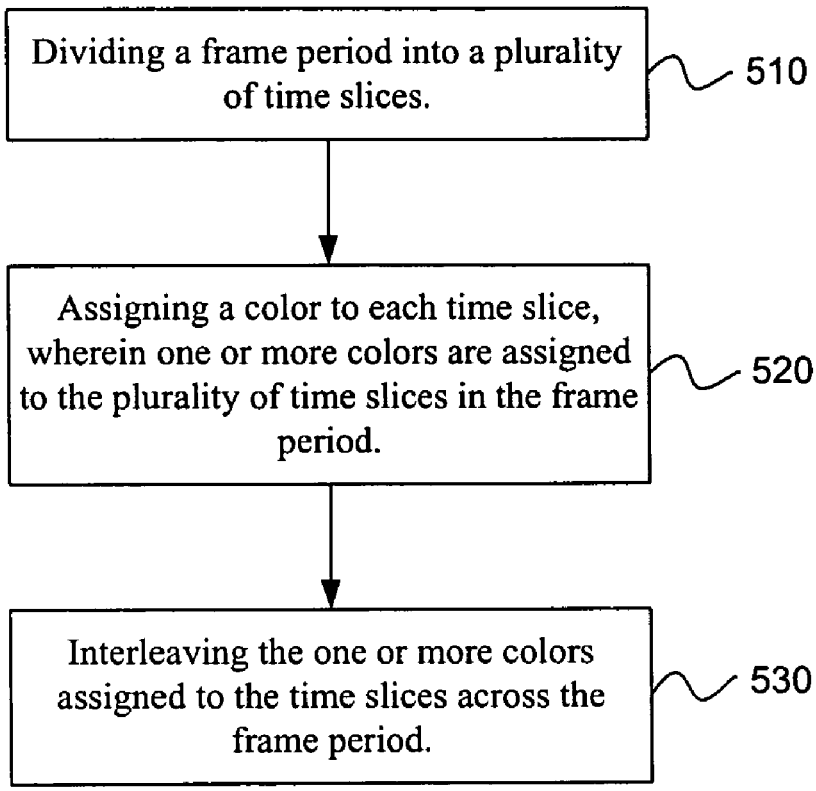
FIG. 5 is a flow chart depicting a method for spreading a non-periodic color signal sent to a spatial light modulator across a frame period to avoid visual artifacts in accordance with an embodiment of the invention.

Another embodiment of the invention provides a method for spreading a non-periodic color signal to a spatial light modulator across a frame period to avoid visual artifacts as depicted in the flow chart of FIG. 5. The method includes the operation of dividing a frame period into a plurality of time slices, as shown in block 510. Each time slice can have a width or time length corresponding to a level of significance in a binary number. Alternatively, the slices can all have the same width or can have non-binary weighted widths. A further operation involves assigning a primary color to each time slice, wherein one or more primary colors are assigned to the plurality of time slices, as shown in block 520. The method also includes the operation of interleaving the one or more primary colors assigned to the time slices across the frame period, as shown in block 530. A color can be assigned to each time slice and the colors interleaved throughout the frame period according to a lookup table. The interleaving can be done in such a manner that it will minimize visual artifacts. The term interleaving is defined generally here as alternating or mixing one or more time slices of primary colors, alternating a primary color with black, the use of a primary color in every time slice for full color saturation, or other interleaving schemes that can be created by those skilled in the art.

Figure 6:
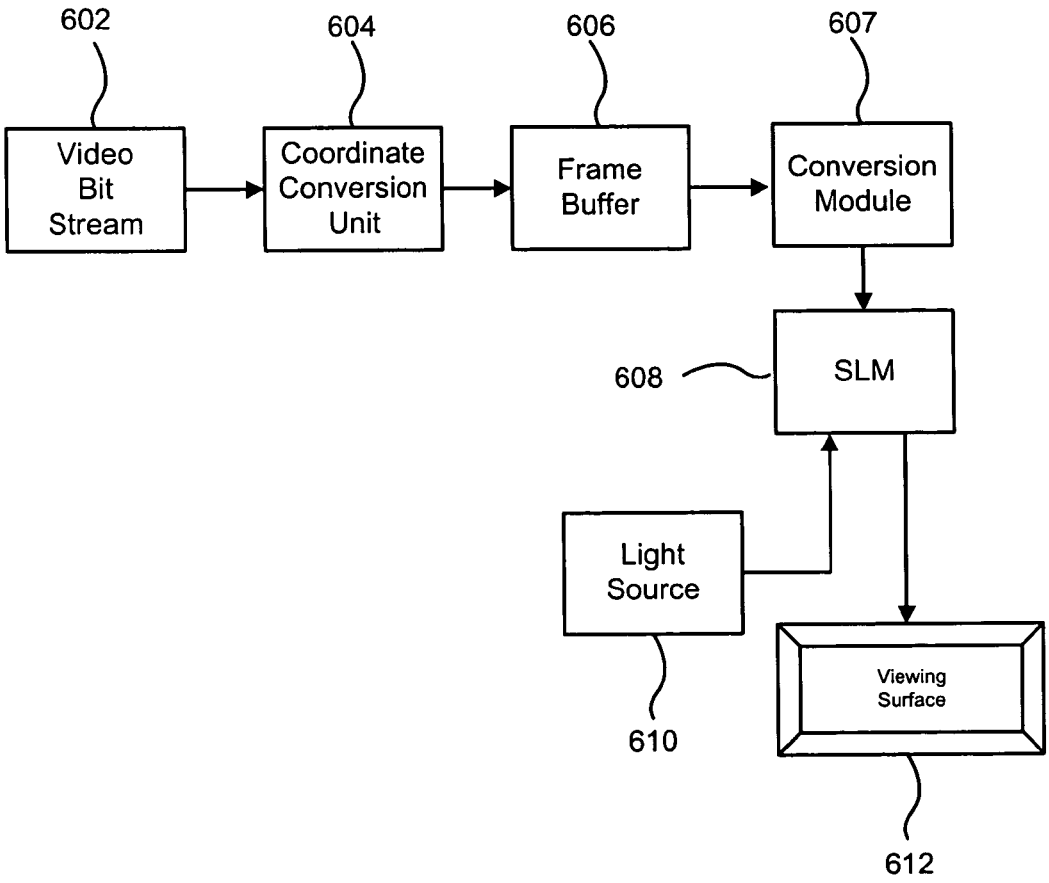
FIG. 6 is a block diagram showing a system for projecting light from an SLM in accordance with an embodiment of the present invention.

A further embodiment of the invention provides a system for generating a range of colors using multiple discrete colors in a non-periodic fashion. A video bit stream 602, as shown in FIG. 6, can be input into a coordinate conversion unit 604. The video bit stream can be any signal containing video information in a digital format. The digital format may be a previously established format, such as MPEG-2, or it may be a format unique to the present invention.

The coordinate conversion unit 604 can compute the voltage level and time combination via a lookup table. The voltage values can then be put into a frame buffer 606, where they can be stored. The values from the frame buffer can be sent to the conversion module 607 to convert the pixel information to a sequence of control signals for controlling each pixel element in the spatial light modulator. Next, the voltage values or pixel information can be sent to the SLM 608 in the proper sequence. A light source 610 is used to input a relatively high intensity light into the SLM. The variable capacitors in the SLM can then be actuated via the voltage levels determined in the coordinate conversion unit. The voltage levels are set such that each pixel plate in each variable capacitor can produce a predetermined primary color. The pixel plates can be actuated at a high enough speed to allow predetermined primary colors to be displayed for at least one time slice of a frame period. The frame buffer can be used to control the SLM, allowing the colors to be interleaved in such a manner as to minimize visual artifacts caused by sequential systems. The colored light can be projected out of the SLM to a viewing surface 612, such that a human eye can view the projection as a photorealistic moving picture with maximum brightness and contrast and a minimum of visual artifacts.

In an alternative embodiment, the SLM 608 can be multiple SLMs such as more than one interferometric modulator or a combination of a pixelated color modulator and a mirror array. The color generation method of the present invention can apply to a variety of configurations.

Embodiments of the present invention enable a digital light device or color modulator to produce an improved display by spreading color signals over the frame period in a manner that can minimize visual artifacts. By interleaving multiple colors in a non-periodic fashion, the digital light device can produce clear, bright images. The colors can also be properly weighted without causing visual flicker or other distortions.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments of the invention. It will be apparent to those of ordinary skill in the art that numerous modifications can be made without departing from the principles and concepts of the invention as set forth in the claims.

What is claimed is:

1. A method for spreading a non-periodic color signal sent to a spatial light modulator across a frame period, comprising the steps of:

dividing a frame period into a plurality of time slices;

assigning a color to each of the plurality time slices; and interleaving one or more colors assigned to the time slices across the frame period in a non-periodic manner.

2. A method as in claim 1, further comprising the steps of:

Characterizing a desired intensity by an intensity value, wherein the intensity value is a binary number;

assigning each time slice to a bit in the binary number; and spreading one or more colors across the frame period based on the assignment of each time slice to a bit in the binary number, wherein at least one of the one or more colors is assigned to each bit.

3. A method as in claim 2, further comprising the step of weighting each bit of the binary number such that more significant bits have a greater number of the time slices assigned to them.

4. A method as in claim 3, further comprising the step of dispersing bits substantially across the frame period.

5. A method as in claim 2, wherein the step of spreading the one or more colors further comprises the step of assigning one color to each bit according to a lookup table.

6. A method for generating images while avoiding visual artifacts in a spatial light modulator which can provide a range of colors for each pixel in a non-periodic manner, comprising the steps of:

receiving an incoming color value;

determining control signals needed to produce one or more colors to generate the incoming color value;

dividing a frame period into time slices; and assigning at least one of the one or more colors to each time slice in a non-periodic manner.

7. The method of claim 6, further comprising the steps of:

determining an intensity of the incoming color value;

representing the intensity as a binary number with n bits;

dividing the frame period into $2^n-1$ time slices;

dedicating a predetermined number of the time slices to at least one of the one or more colors; and directing remaining time slices to be in an off position.

8. The method of claim 7, wherein the intensity of the incoming color value is controlled using pulse width modulation.

9. The method of claim 8, wherein the intensity of the incoming color value is represented by a binary number with at least 8 bits.

10. The method of claim 6, further comprising the steps of:

determining a white component and a monochrome component for a pixel in the frame period; and selecting a voltage level and time value corresponding to the monochrome component plus the monochrome component and its compliment.

11. The method of claim 6, further comprising the step of producing a continuous array of colors in a non-periodic fashion for each pixel projected using the spatial light modulator.

12. The method of claim 11, further comprising the step of using a projection device with the continuous array of colors generated in a non-periodic fashion.

13. A method for outputting a continuous range of colors in a non periodic fashion from a spatial light modulator device, comprising the steps of:

receiving a color value for each pixel in a frame;

determining at least one color hue to produce one or more discrete colors to generate the color value; and interleaving the one or more discrete colors across a frame period in a non-periodic manner.

14. A system for generating pixels to be displayed on a viewing surface, using a spatial light modulator having an array of pixel elements each capable of producing hues for the pixels, comprising:

a frame buffer configured for storing pixel information indicative of a color value for each pixel element for a frame period, the pixel information defining non-periodic primary color sequence for each of a plurality of time slices during the frame period for each pixel element; and a conversion module associated with the spatial light modulator, the conversion module being configured to convert the pixel information to a sequence of control signals for controlling each pixel element in the spatial light modulator.

15. The system of claim 14, wherein selected pixel elements include at least one primary color that is dispersed across the frame period for the non-periodic primary color sequence.

16. The system of claim 14, wherein selected pixel elements include two or more primary colors that are interleaved across the frame period for the non-periodic primary color sequence.

17. The system of claim 16, wherein the spatial light modulator uses a variable capacitor to produce a continuous array of colors.

18. The system of claim 14, wherein each pixel element of the spatial light modulator is capable of producing a continuous array of colors in a non-periodic fashion for each pixel projected.

19. The system of claim 18, further comprising a projection device used with the continuous array of colors generated in a non-periodic fashion.

20. The system of claim 18, wherein the continuous range of colors comprises electromagnetic radiation in the visible spectrum, infrared radiation, and ultraviolet radiation.

21. The system of claim 14, wherein the spatial light modulator is configured to produce multiple discrete colors in a non-periodic fashion for each of the pixel projected color hues.

22. The system of claim 21, wherein each pixel element of the spatial light modulator is capable of generating a fixed number of different color hues.

23. The system of claim 22, wherein the fixed number of different hues comprises red, green, blue, and black.

24. The system of claim 22, wherein the fixed number of different hues comprise red, green, blue, cyan, magenta, yellow, and black.

25. The system of claim 22, wherein the continuous range of hues comprises electromagnetic radiation in the visible spectrum.

26. The system of claim 14, wherein the spatial light modulator uses a dual capacitor device to produce a plurality of discrete hues in a non-periodic fashion for each pixel projected.

27. A device for spreading a non-periodic color signal sent to a spatial light modulator across a frame period to avoid visual artifacts, comprising the steps of:

a means for dividing a frame period into a plurality of time slices;

a means for assigning a color to each time slice, wherein one or more colors are assigned to the plurality of time slices in the frame period; and a means for interleaving the one or more colors assigned to the time slices across the frame period.

28. A method for generating a pixel having a color value during each frame period of a plurality of frame periods, comprising the steps of:

providing at least one primary color to be used to approximate the color value for the pixel;

dividing the frame period into a plurality of time slices;

assigning at least one primary color to each of the plurality of time slices in an interleaved and non-periodic manner throughout the frame period.

29. A method as in claim 28, further comprising sending electrical control signals to a pixel element of a light modulator during each of the time slices such that the pixel element outputs the at least one primary color assigned to each of the time slices.

30. The method of claim 28 wherein the light modulator electrically varies an interference gap that defines a spectral distribution with a peak corresponding to the at least one primary color.

31. The method of claim 28 wherein the plurality of frame periods include periodic time slices and different primary colors are displayed for periodic time slices for different frame periods.

32. The method of claim 28, wherein the each of the one or more primary colors is selected from a selection of primary colors including red, green, blue, black, cyan, yellow, orange, violet, and magenta.

33. A method for generating a pixel during a frame period, comprising:

receiving an incoming color value indicative of a color and intensity of the pixel;

selecting one or more primary colors from a continuous range of primary colors based on the incoming color value;

dividing the frame period into time slices; and assigning a primary color from the one or more primary colors to identified time slices in an interleaved and non-periodic manner across the frame period to define the color value.

34. The method of claim 33, wherein the incoming color value includes a white color component and, the one or more primary colors includes two complementary colors used to define the white component.

35. The method of claim 33, wherein the one or more primary colors includes a single primary color when there is no while component.

36. The method of claim 33, further comprising the step of determining a white component and a monochrome component of the color value, wherein the one or more primary colors includes a single primary color to represent the monochrome component and the single primary color and the complement of the single primary color are used to represent the white component.

* * * * *

UNITED STATES PATENT AND TRADEMARK OFFICE

CERTIFICATE OF CORRECTION

PATENT NO. : 7,936,362 B2
APPLICATION NO. : 10/909087
DATED : May 3, 2011
INVENTOR(S) : Matthew Gelhaus et al.

It is certified that error appears in the above-identified patent and that said Letters Patent is hereby corrected as shown below:

In column 8, line 1, in Claim 1, delete “plurality time slices” and insert -- plurality of time slices --, therefor.

In column 8, line 5, in Claim 2, delete “Characterizing” and insert -- characterizing --, therefor.

In column 10, line 45, in Claim 34, delete “and,” and insert -- and --, therefor.

In column 10, line 50, in Claim 35, delete “while” and insert -- white --, therefor.

Signed and Sealed this
Twentieth Day of December, 2011

David J. Kappos
*Director of the United States Patent and Trademark Office*